US010602785B2

(12) United States Patent
Duffy

(10) Patent No.: US 10,602,785 B2
(45) Date of Patent: Mar. 31, 2020

(54) FILTERING FACE-PIECE RESPIRATOR HAVING NOSE CUSHIONING MEMBER

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 373 days.

(21) Appl. No.: 15/659,780

(22) Filed: Jul. 26, 2017

(65) Prior Publication Data

US 2017/0318876 A1 Nov. 9, 2017

Related U.S. Application Data

(62) Division of application No. 14/013,347, filed on Aug. 29, 2013, now Pat. No. 9,770,057.

(51) Int. Cl.
*A41D 13/11* (2006.01)
*A62B 23/02* (2006.01)

(52) U.S. Cl.
CPC ..... *A41D 13/1115* (2013.01); *A41D 13/11* (2013.01); *A41D 13/1161* (2013.01); *A62B 23/025* (2013.01); *Y10T 29/49604* (2015.01)

(58) Field of Classification Search
CPC ..... A41D 13/11; A41D 13/1123; A41D 13/1146; A41D 13/1115; A41D 13/1161; A62B 23/025
See application file for complete search history.

(56) References Cited

U.S. PATENT DOCUMENTS

| | | | | |
|---|---|---|---|---|
| 4,037,593 | A | 7/1977 | Tate | |
| 4,600,002 | A | 7/1986 | Maryyanek et al. | |
| 4,606,341 | A | 8/1986 | Hubbard et al. | |
| 7,036,507 | B2 | 5/2006 | Jensen | |
| 7,185,653 | B2 | 3/2007 | Lee | |
| 8,640,704 | B2 | 2/2014 | Spoo | |
| 9,603,395 | B2 | 3/2017 | Duffy | |
| 9,603,396 | B2 | 3/2017 | Duffy | |
| 9,770,057 | B2 | 9/2017 | Duffy | |
| 9,615,612 | B2 | 11/2017 | Duffy | |
| 2007/0039620 | A1 | 2/2007 | Sustello | |
| 2007/0157932 | A1* | 7/2007 | Cerbini | A41D 13/1138 128/205.27 |
| 2008/0271737 | A1* | 11/2008 | Facer | A41D 13/11 128/205.25 |
| 2010/0313890 | A1 | 12/2010 | Messier | |
| 2011/0315144 | A1 | 12/2011 | Eitzman et al. | |
| 2013/0291877 | A1* | 11/2013 | Nguyen | A62B 23/025 128/863 |

FOREIGN PATENT DOCUMENTS

| | | |
|---|---|---|
| CN | 201135154 | 10/2008 |
| EP | 2298096 | 3/2011 |
| GB | 2329128 | 3/1999 |
| WO | WO 1997/32493 | 9/1997 |
| WO | WO 2004/101074 | 11/2004 |

* cited by examiner

*Primary Examiner* — Tarla R Patel

(57) ABSTRACT

A filtering face-piece respirator 10 that includes a harness 14 and a mask body 12 that has a multi-layer filtering structure 16. The respirator includes a cushioning member 64 positioned proximate the nose area of the mask body 12, enveloped by a layer of the filtering structure 16. The cushioning member 64 is a compressible material and may be elastic. The cushioning member 64 can be positioned directly opposite of a nose clip 56.

12 Claims, 5 Drawing Sheets

FILTERING FACE-PIECE RESPIRATOR HAVING NOSE CUSHIONING MEMBER

CROSS-REFERENCE TO RELATED APPLICATIONS

This is a divisional application of U.S. patent application Ser. No. 14/013,347 pending, filed Aug. 29, 2013, the disclosure of which is incorporated by reference herein in its entirety.

The present invention pertains to a filtering face-piece respirator that includes a cushioning member proximate the nose area of the respirator, the cushioning member positioned within the filtering structure.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded filtering face piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering, face-piece respirators include U.S. Pat. No. 7,131,442 to Kronzer et al, U.S. Pat. Nos. 6,923,182, 6,041,782 to Angadjivand et al., U.S. Pat. No. 4,807,619 to Dyrud et al., and U.S. Pat. No. 4,536,440 to Berg.

Flat-fold respirators—as their name implies—can be folded flat for shipping and storage. They also can be opened into a cup-shaped configuration for use. Examples of flat-fold respirators are shown in U.S. Pat. Nos. 6,568,392 and 6,484,722 to Bostock et al., and U.S. Pat. No. 6,394,090 to Chen. Some flat-fold respirators have been designed with weld lines, seams, and folds, to help maintain their cup-shaped configuration during use. Stiffening members also have been incorporated into panels of the mask body (see U.S. Patent Application Publications 2001/0067700 to Duffy et al., 2010/0154805 to Duffy et al., and U.S. Design Pat. 659,821 to Spoo et al.).

The present invention, as described below, provides an improved fitting, comfortable respirator.

SUMMARY OF THE INVENTION

The present invention provides a filtering face-piece respirator that comprises a mask body and a cushioning member proximate the nose region of the mask body. The mask body comprises a filtering structure that contains one or more filter media layers sandwiched between an outer cover web and an inner cover web. The cushioning member is positioned between the outer cover web and an inner cover web. In some embodiments, a nose clip is also present in mask body proximate the nose region, with the nose clip positioned between the outer cover web and an inner cover web. In these embodiments, the cushioning member is positioned between the nose clip and the inner cover web, sometimes with an intermediate layer, such as a filter media layer, between the nose clip and the cushioning member.

By having such a cushioning member, the comfort and sealing of the respirator to the face of the wearer is enhanced. When the cushioning member is positioned between a nose clip and the wearer's face, the cushioning member reduces the pressure of the nose clip on the wearer's nose and/or upper cheekbones. By having the cushioning member retained within or among the layers of the filtering structure, the need for adhesives, which may outgas odor and/or VOCs, is eliminated. Additionally, some wearers may have allergies to certain adhesives. Further, having the cushioning member retained within or among the layers of the filtering structure leaves no surface of the cushioning member exposed, as some wearers may have allergies to certain foam materials.

GLOSSARY

The terms set forth below will have the meanings as defined:

"comprises" or "comprising" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, etc.) but which may be suspended in air;

"crosswise dimension" is the dimension that extends laterally across the respirator, from side-to-side when the respirator is viewed from the front;

"cup-shaped configuration" and variations thereof mean any vessel-type shape that is capable of adequately covering the nose and mouth of a person;

"cushioning member" and variations thereof mean a compressible material that does not include the filter media or the filtering structure;

"exterior gas space" means the ambient atmospheric gas space into which exhaled gas enters after passing through and beyond the mask body and/or exhalation valve;

"exterior surface" means the surface of the mask body exposed to ambient atmospheric gas space when the mask body is positioned on the person's face;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that filters air;

"folded inwardly" means being bent back towards the part from which extends;

"harness" means a structure or combination of parts that assists in supporting the mask body on a wearer's face;

"interior gas space" means the space between a mask body and a person's face;

"interior surface" means the surface of the mask body closest to a person's face when the mask body is positioned on the person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space (including the seams and bonds that join layers and parts thereof together);

"nose clip" means a mechanical device (other than a nose foam), which device is adapted for use on a mask body to improve the seal at least around a wearer's nose;

"perimeter" means the outer edge of the mask body, which outer edge would be disposed generally proximate to a wearer's face when the respirator is being donned by a person; a "perimeter segment" is a portion of the perimeter;

"pleat" means a portion that is designed to be or is folded back upon itself;

"polymeric" and "plastic" each mean a material that mainly includes one or more polymers and that may contain other ingredients as well;

"respirator" means an air filtration device that is worn by a person to provide the wearer with clean air to breathe;

"snug fit" or "fit snugly" means that an essentially airtight (or substantially leak-free) fit is provided (between the mask body and the wearer's face); and "transversely extending" means extending generally in the crosswise dimension.

DETAILED DESCRIPTION OF PREFERRED EMBODIMENTS

Figure 1:
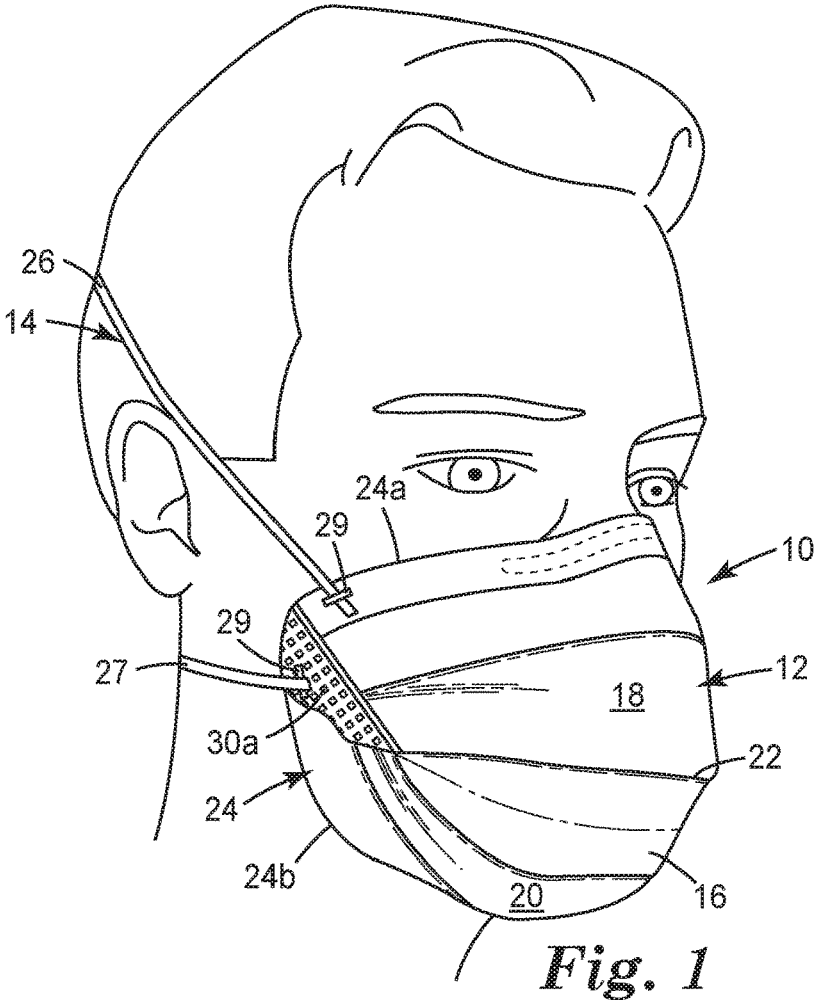
FIG. 1 is a front perspective view of a flat-fold filtering face-piece respirator 10 being worn on a person's face.

In practicing the present invention, a filtering face-piece respirator is provided that has a cushioning member at the region of the respirator proximate the nose and optionally the upper cheekbones of the wearer, when the mask is being worn on the face of a wearer. The cushioning member enhances the comfort and sealing of the respirator to the face of the wearer.

In the following description, reference is made to the accompanying drawings that form a part hereof and in which are shown by way of illustration various specific embodiments. The various elements and reference numerals of one embodiment described herein are consistent with and the same as the similar elements and reference numerals of another embodiment described herein, unless indicated otherwise. It is to be understood that other embodiments are contemplated and may be made without departing from the scope or spirit of the present invention. The following description, therefore, is not to be taken in a limiting sense. While the present invention is not so limited, an appreciation of various aspects of the invention will be gained through a discussion of the examples provided below.

Figure 2:
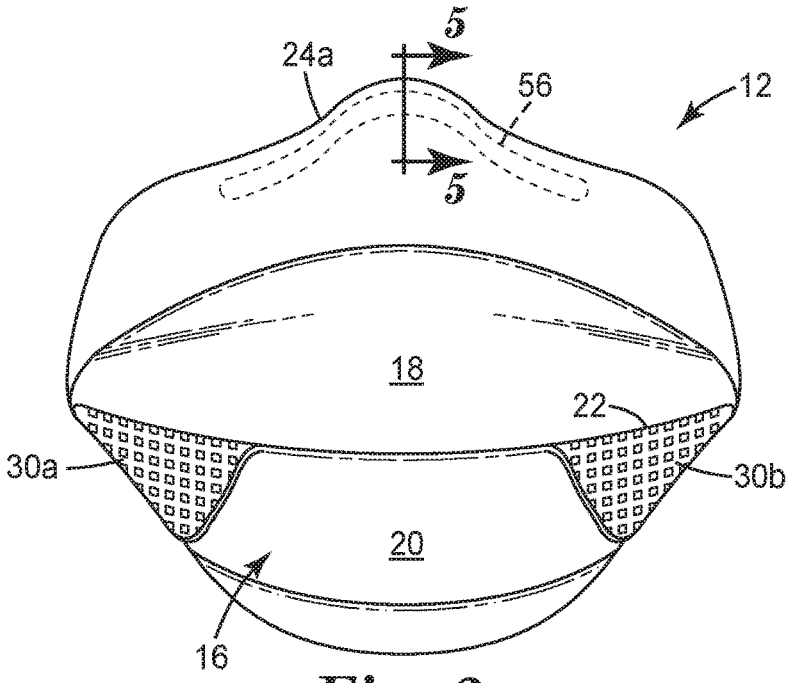
FIG. 2 is a front view of a mask body 12 of respirator 10 of FIG. 1.
Figure 3A:
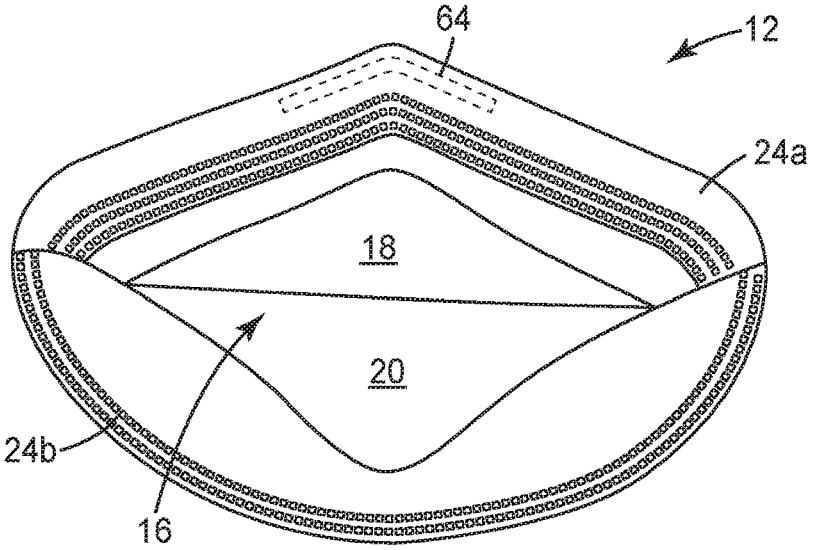
FIG. 3*a* is a back view of the mask body 12, the mask body 12 having a cushioning member 64.
Figure 3B:
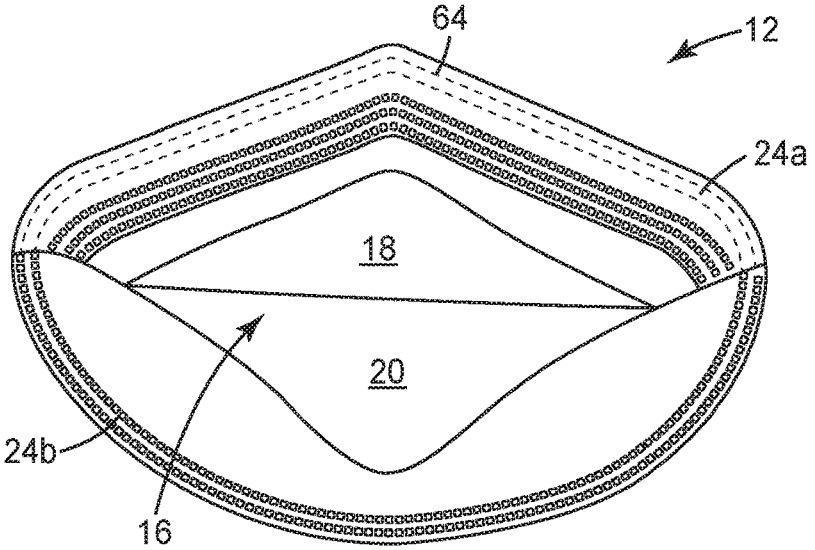
FIG. 3*b* is a back view of the mask body 12 showing an alternate embodiment of the cushioning member 64.

Turning to the figures, FIG. 1 shows an example of a filtering face-piece respirator 10 that may be used in connection with the present invention to provide clean air for the wearer to breathe. The filtering face-piece respirator 10 includes a mask body 12 and a harness 14. For simplicity, FIGS. 2, 3*a* and 3*b* show mask body 12 without harness 14. The mask body 12 has a filtering structure 16 through which inhaled air must pass before entering the wearer's respiratory system. The filtering structure 16 removes contaminants from the ambient environment so that the wearer breathes clean air. The filtering structure 16 may take on a variety of different shapes and configurations and typically is adapted so that it properly fits against the wearer's face or within a support structure. Generally the shape and configuration of the filtering structure 16 corresponds to the general shape of the mask body 12.

The mask body 12 includes a top portion 18 and a bottom portion 20 separated by a line of demarcation 22. In this particular embodiment, the line of demarcation 22 is a fold or pleat that extends transversely across the central portion of the mask body from side-to-side. The mask body 12 also includes a perimeter 24 that includes an upper segment 24*a* at top portion 18 and a lower segment 24*b* at bottom portion 20.

The harness 14 (FIG. 1) has a first, upper strap 26 that is secured to the top portion 18 of mask body 12 by a staple 29 adjacent to the perimeter upper segment 24*a*. The harness 14 also has a second, lower strap 27 that is secured by a staple 29, in this embodiment, to a flange 30*a*. The straps 26, 27 may be made from a variety of materials, such as thermoset rubbers, thermoplastic elastomers, braided or knitted yarn and/or rubber combinations, inelastic braided components, and the like. The straps 26, 27 preferably can be expanded to greater than twice their total length and be returned to their relaxed state. The straps 26, 27 also could possibly be increased to three or four times their relaxed state length and can be returned to their original condition without any damage thereto when the tensile forces are removed. The straps 26, 27 may be continuous straps or may have a plurality of parts, which can be joined together by further fasteners or buckles. Alternatively, the straps may form a loop that is placed around the wearer's ears.

FIG. 2 shows that the mask body 12 has first and second flanges 30*a* and 30*b* located on opposing sides of the mask body 12. An end of the second strap 27 is stapled to each flange 30*a*, 30*b*. The flanges 30*a* and 30*b* are folded inwardly towards the filtering structure 16 in contact therewith. Additional details regarding flanges 30*a* and 30*b* and other features of respirator 10 and mask body 12 can be found in U.S. patent application Ser. No. 13/727,923 filed Dec. 27, 2012, titled "Filtering Face-Piece Respirator Having Folded Flange," the entire disclosure of which is incorporated herein by reference.

A nose clip 56 (FIG. 2) is disposed on the top portion 18 of the mask body adjacent to the perimeter segment 24*a*, centrally positioned between the mask body side edges, to assist in achieving an appropriate fit on and around the nose and upper cheek bones. The nose clip 56 may be made from a pliable metal or plastic that is capable of being manually adapted by the wearer to fit the contour of the wearer's nose. The nose clip 56 may comprise, for example, a malleable or pliable soft band of metal such as aluminum, which can be shaped to hold the mask in a desired fitting relationship over the nose of the wearer and where the nose meets the cheek.

A nose cushioning member 64 (FIGS. 3*a*, 3*b*) is also disposed on the top portion 18 of the mask body 12, the cushioning member 64 being closer to the interior surface or interior gas space defined by the mask body than the nose clip 56. That is, the cushioning member 64 is positioned between the nose clip 56 and the interior surface of the mask body 12 and the wearer's face.

The cushioning member 64 is shaped and sized to enhance the comfort of the nose clip 56 when the mask is being worn. Preferably, the cushioning member 64 is at least as long and wide as the nose clip 56, thus overlapping the entire area of the nose clip 56, however in some embodiments, depending on the thickness of the cushioning member 64, the cushioning member 64 may be shorter and/or narrower than the nose clip 56. In FIG. 3*a*, the cushioning member 64 has essentially the same length as the nose clip 56 (not shown in FIG. 3*a*) wherein in FIG. 3*b*, the cushioning member 64 is longer than the nose clip 56 (not shown in FIG. 3*b*) and extends the entire length of upper perimeter segment 24*a*.

The cushioning member 64 is present within the layers of the filtering structure 16, so that at least a portion of filtering structure 16 is positioned between the cushioning member 64 and the interior surface of the mask body.

The filtering structure 16 that is used in the mask body 12 can be of a particle capture or gas and vapor type filter. The filtering structure 16 also may be a barrier layer that prevents the transfer of liquid from one side of the filter layer to another to prevent, for instance, liquid aerosols or liquid splashes (e.g., blood) from penetrating the filter layer. Multiple layers of similar or dissimilar filter media may be used to construct the filtering structure 16 as the application requires. Filtration layers that may be beneficially employed in a layered mask body are generally low in pressure drop (for example, less than about 195 to 295 Pascals at a face velocity of 13.8 centimeters per second) to minimize the breathing work of the mask wearer. Filtration layers additionally may be flexible and may have sufficient shear strength so that they generally retain their structure under the expected use conditions.

Figure 4:
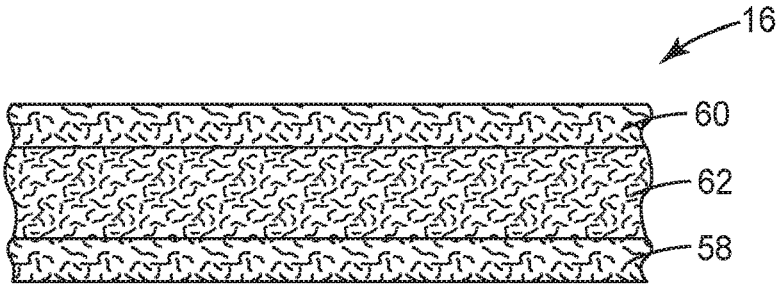
FIG. 4 is a cross-sectional view of a filtering structure 16 suitable for use in the mask body 12 of FIG. 2.

FIG. 4 shows an exemplary filtering structure 16 having multiple layers such as an inner cover web 58, an outer cover web 60, and a filtration layer 62; when the mask is on the face of the wearer, the inner cover web 58 is closest to the face of the wearer and to the interior gas space of the mask body 12. The filtering structure 16 also may have a structural netting or mesh juxtaposed against at least one or more of the layers 58, 60, or 62, typically against the outer surface of the outer cover web 60, that assist in providing a cup-shaped configuration. The filtering structure 16 also could have one or more horizontal and/or vertical lines of demarcation (e.g., pleat, fold, or rib) that contribute to its structural integrity.

The inner cover web 58 can be used to provide a smooth surface for contacting the wearer's face, and an outer cover web 60 can be used to entrap loose fibers in the mask body or for aesthetic reasons. Both cover webs 58, 60 protect the filtration layer 62. The cover webs 58, 60 typically do not provide any substantial filtering benefits to the filtering structure 16, although outer cover web 60 can act as a pre-filter to the filtration layer 62. To obtain a suitable degree of comfort, the inner cover web 58 preferably has a comparatively low basis weight and is formed from comparatively fine fibers, often finer than those of outer cover web 60. Either or both cover webs 58, 60 may be fashioned to have a basis weight of about 5 to about 70 g/m$^2$ (typically about 17 to 51 g/m$^2$ and in some embodiments 34 to 51 g/m$^2$), and the fibers may be less than 3.5 denier (typically less than 2 denier, and more typically less than 1 denier) but greater than 0.1. Fibers used in the cover webs 58, 60 often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Typically, the cover webs 58, 60 are made from a selection of nonwoven materials that provide a comfortable feel, particularly on the side of the filtering structure that makes contact with the wearer's face, i.e., inner cover web 58. Suitable materials for the cover web may be blown microfiber (BMF) materials, particularly polyolefin BMF materials, for example polypropylene BMF materials (including polypropylene blends and also blends of polypropylene and polyethylene). Spun-bond fibers also may be used.

A typical cover web may be made from polypropylene or a polypropylene/polyolefin blend that contains 50 weight percent or more polypropylene. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. Cover webs 58, 60 preferably have very few fibers protruding from the web surface after processing and therefore have a smooth outer surface.

The filtration layer 62 is typically chosen to achieve a desired filtering effect. The filtration layer 62 generally will remove a high percentage of particles and/or or other contaminants from the gaseous stream that passes through it. For fibrous filter layers, the fibers selected depend upon the kind of substance to be filtered.

The filtration layer 62 may come in a variety of shapes and forms and typically has a thickness of about 0.2 millimeters (mm) to 5 mm, more typically about 0.3 mm to 3 mm (e.g., about 0.5 mm), and it could be a generally planar web or it could be corrugated to provide an expanded surface area. The filtration layer also may include multiple filtration layers joined together by an adhesive or any other means. Essentially any suitable material that is known (or later developed) for forming a filtering layer may be used as the filtering material. Webs of melt-blown fibers, especially when in a persistent electrically charged (electret) form are especially useful. Electrically charged fibrillated-film fibers also may be suitable, as well as rosin-wool fibrous webs and webs of glass fibers or solution-blown, or electrostatically sprayed fibers, especially in microfilm form. Also, additives can be included in the fibers to enhance the filtration performance of webs produced through a hydro-charging process. Fluorine atoms, in particular, can be disposed at the surface of the fibers in the filter layer to improve filtration performance in an oily mist environment.

Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles.

Although the filtering structure 16 has been illustrated in FIG. 4 with one filtration layer 62 and two cover webs 58, 60, the filtering structure 16 may comprise a plurality or a combination of filtration layers 62. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors.

During respirator use, incoming air passes sequentially through layers 60, 62, and 58 before entering the mask interior. The air that is within the interior gas space of the mask body may then be inhaled by the wearer. When a wearer exhales, the air passes in the opposite direction sequentially through layers 58, 62, and 60. Alternatively, an exhalation valve (not shown) may be provided on the mask body 12 to allow exhaled air to be rapidly purged from the interior gas space to enter the exterior gas space without passing through filtering structure 16. The use of an exhalation valve may improve wearer comfort by rapidly removing the warm moist exhaled air from the mask interior. Essentially any exhalation valve that provides a suitable pressure drop and that can be properly secured to the mask body may be used in connection with the present invention to rapidly deliver exhaled air from the interior gas space to the exterior gas space.

Figure 5A:
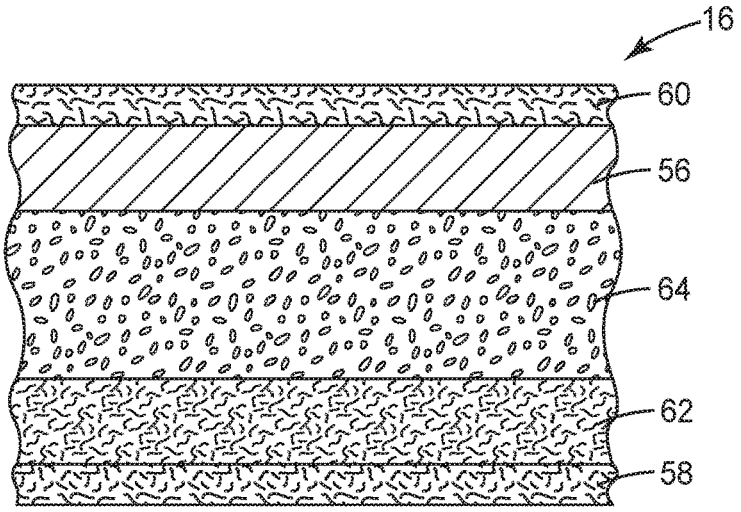
FIG. 5*a* is a cross-sectional view of a first embodiment of the filtering structure 16, the nose clip 56 and the cushioning member 64 taken along line 5-5 of FIG. 2.
Figure 5B:
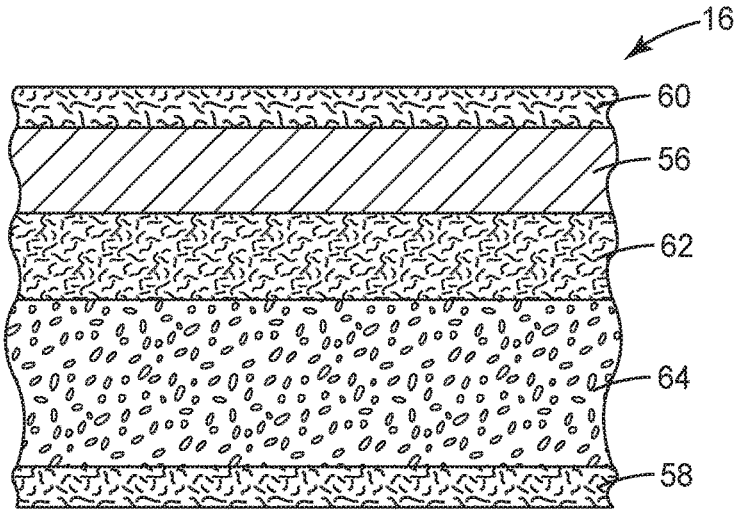
FIG. 5*b* is a cross-sectional view of a second embodiment of the filtering structure 16, the nose clip 56 and the cushioning member 64 taken along line 5-5 of FIG. 2.
Figure 5C:
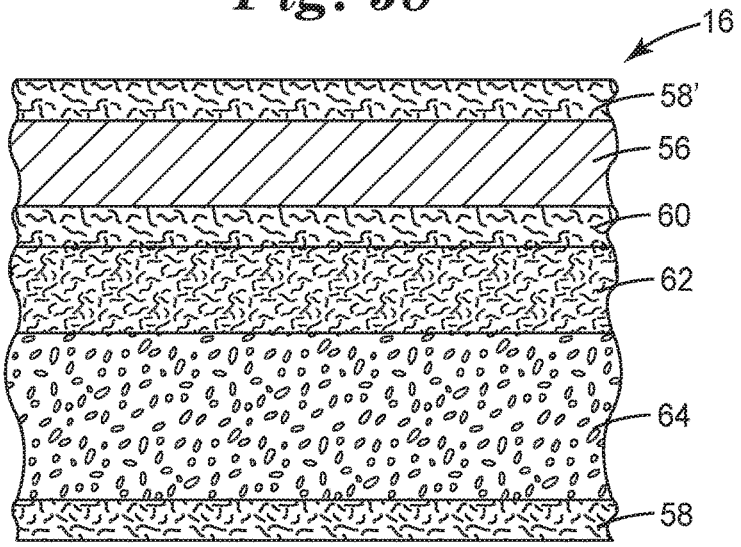
FIG. 5*c* is a cross-sectional view of a third embodiment of the filtering structure 16, the nose clip 56 and the cushioning member 64 taken along line 5-5 of FIG. 2.

FIGS. 5*a*, 5*b* and 5*c* illustrate ternate embodiments of the placement of the nose clip 56 and the cushioning member 64 within the filtering structure 16. In all embodiments, the cushioning member 64 is positioned between the nose clip 56 and the inner cover web 58.

In FIG. 5*a*, the cushioning member 64 is positioned between the nose clip 56 and the filtration layer 62 with no intervening layer between member 64 and the nose clip 56. In FIG. 5*b*, the filtration layer 62 is positioned between the cushioning member 64 and the nose clip 56. In both of these embodiments, the inner cover web 58 and the outer cover web 60 surround, envelope, or otherwise are present on both sides of the cushioning member 64 and the nose clip 56. In FIG. 5*c*, the inner cover web 58 has been wrapped or folded around the construction, providing a second layer of the inner cover web 58' between the nose clip 56 and the outer surface of the construction. In this embodiment, the nose clip 56 is present between the inner cover web 58' and the outer cover web 60.

Figure 6A:
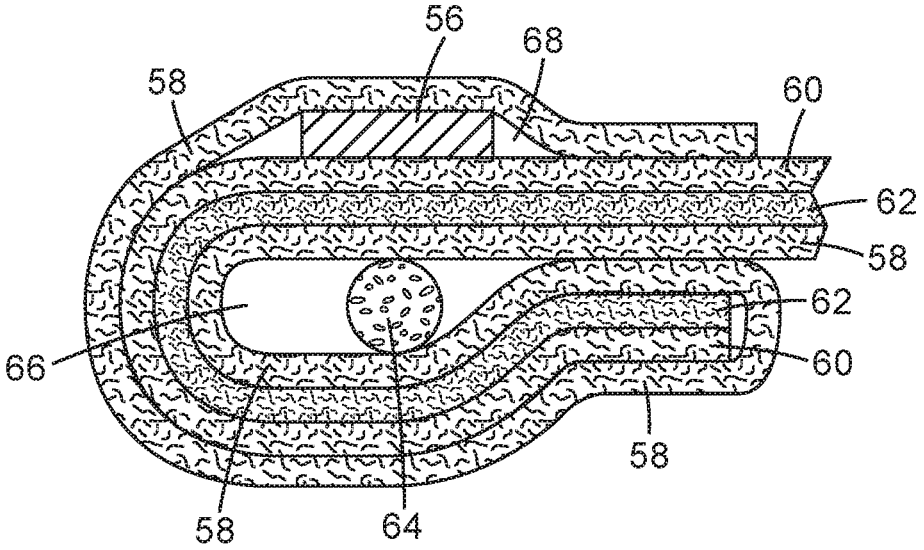
FIG. 6*a* is an alternate cross-sectional view of a fourth embodiment of the filtering structure 16, the nose clip 56 and the cushioning member 64.
Figure 6B:
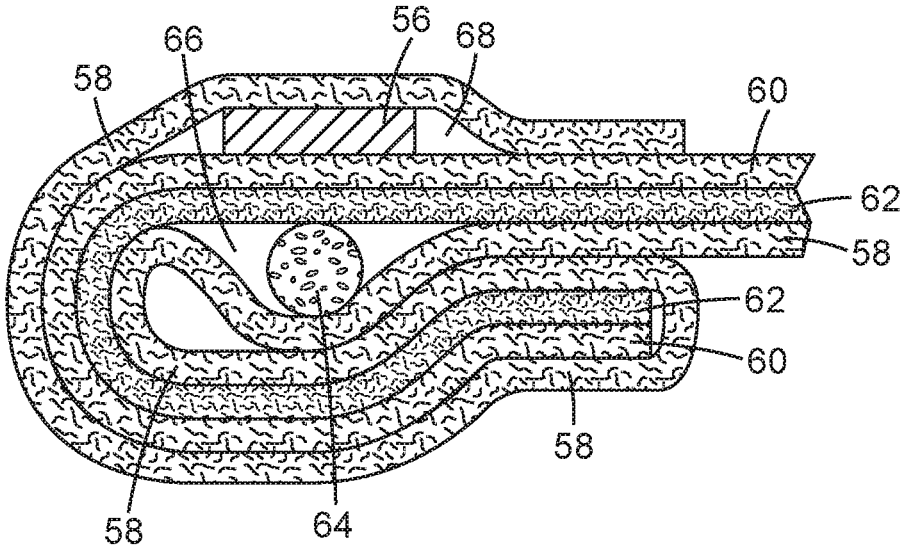
FIG. 6*b* is another alternate cross-sectional view of a fifth embodiment of the filtering structure 16, the nose clip 56 and the cushioning member 64, similar to the view of FIG. 5*c*.

FIGS. 6*a* and 6*b* show constructions where the multilayer filtering structure 16 is folded to form a pocket 66 in which the cushioning member 64 is positioned; it is noted that the filtering structure 16 and the cushioning member 64 may not be drawn to their proper relative scale. In these constructions, the webs 58, 60 and the filtration layer 62 are folded back upon themselves to form the pocket 66. Additionally in these illustrated constructions, the inner cover web 58 is further folded back on and around the fold to form a pocket 68 in which the nose clip 56 is positioned. In these embodiments, at least one layer of the filtering structure (i.e., at least one of the webs 58, 60 and the filtration layer 62) is present between the pocket 66 and the pocket 68; in some embodiments, the pocket 66 and the pocket 68 may be a single pocket having both the nose clip 56 and the cushioning member 64 therein.

In FIG. 6*a*, all of the inner cover web 58, the outer cover web 60 and the filtration layer 62 are positioned between the nose clip 56 and the cushioning member 64, whereas in FIG. 6*b*, the outer cover web 60 and the filtration layer 62 are positioned between the nose clip 56 and the cushioning member 64. In alternate embodiments, the inner cover web 58 may not cover the nose clip 56, but rather nose clip 56 remains exposed on the surface of the mask body, i.e., on the outer cover web 60.

By having the cushioning member 64 retained within or among the cover webs 58, 60, as in each of FIGS. 5*a*, 5*b*, 5*c*, 6*a*, 6*b* and variations thereof, various benefits are obtained over conventional foams that are adhered to the inner surface of the mask body (e.g., to inner cover web 58). For example, by having the cushioning member 64 securely retained or enveloped within the cover webs 58, 60, the need for adhesives, which may outgas odor and/or VOCs, is eliminated. Additionally, some wearers may have allergies to certain adhesives, such as acrylates. Another benefit of having the cushioning member 64 enveloped within the cover webs 58, 60 is that the enveloped cushioning member 64 has no exposed surface; some wearers may have allergies to certain foam materials, such as latex. Further, the enveloped cushioning member 64 does not discolor or crumble, as does foam when exposed to UV light.

The cushioning member 64 has an elongated shape and can have any suitable cross-sectional shape, such as square, rectangular, circular, oval or other oblong, etc. The cushioning member 64 may have a solid cross-section or may be hollow, such as a tube. In some embodiments, the cushioning member 64 has the same length and width as the nose clip 56, as in FIG. 3*a*, whereas in other embodiments, the cushioning member 64 has a longer length and/or wider width than the nose clip 56, as in FIG. 3*b*. In some embodiments, as shown in FIG. 3*b*, the cushioning member 64 extends side-to-side (i.e., the entire transverse width) of the mask body 12. Such a continuous cushioning member 64 may provide cushioning and/or improved seating and/or sealing across the entire upper cheek region of the wearer's face.

As an example, if the nose clip 56 has a width of about 5 mm and a length of about 8.5 cm, a suitable cushioning member 64, which is an elastic rope optionally having a sheath therearound, has a diameter of about 5 mm and a length of about 9.5 cm. As another example, a suitable cushioning member 64, which is a closed cell foam insert, has a thickness of about 3 mm, a width of about 6 mm, and a length of about 9 cm, wherein the thickness is the dimension of the cushioning member in the direction from the nose clip 56 to the inner cover web. Another example is a similarly sized and shaped cushioning member 64, but formed from open cell foam.

The thickness of the cushioning member 64 is at least 1 mm and no more than 1 cm. In some embodiments, the thickness of the cushioning member 64 is within the range of 2 mm to 5 mm. The thickness of the cushioning member 64 is at least 2 mm and no more than 20 mm, typically no more than 10 mm.

The cushioning member 64 is a compressible material, typically compressible from an initial or relaxed thickness to a thickness at least 10% less or at least 25% less than the initial thickness, often at least 50% less than the initial thickness. In some embodiments, the cushioning member 64 compresses from its initial state to a thickness at least 75% less than the initial thickness. As an example, a cushioning member 64 that has a relaxed thickness of 1 cm, when compressed 75%, has a compressed thickness of 0.25 cm or 2.5 mm. In most embodiments, the cushioning member 64 compresses no more than 90% less than the initial thickness; as an example, a cushioning member 64 that has a relaxed thickness of 1 cm, when compressed 90%, has a compressed thickness of 1 mm. After removal of any compression force from the cushioning member 64, the cushioning member returns to at least 50% or more of its initial thickness, preferably at least 70%.

Examples of suitable materials for the cushioning member 64 include polyurethane and acrylic latex. In some embodiments, a rubber may be a suitable material for the cushioning member 64. For embodiments where the cushioning member 64 is a foam or foamed material, the material may be either an open cell foam or a closed cell foam. In some embodiments, the foamed material may be formed in situ, for example, a material that expands upon application. The cushioning member 64 may be a composite of materials. For example, a rope-like cushioning member can have a foam core encircled by a nylon or other sheath. Yet another example of a suitable material for the cushioning member 64 is a soft resilient polymer, such as a thermoplastic elastomer. Such a material may be also formed in situ, being formed (e.g., extruded) immediately prior to incorporation into the mask body. Any of the cushioning members 64 can include reinforcement features, such as internal cross bracing, to adjust the compression properties of the member.

In some embodiments, cushioning member 64 has an elastic nature in at least its longitudinal direction. Ranges of suitable elasticity include 5% to 100% elongation over a relaxed state, and 25% to 50% elongation.

As indicated above, the nose clip 56 is formed from a semi-rigid, malleable material, such as metal, and is configured to seat against the mask wearer's nose and upper cheeks. The cushioning member 64 improves the comfort of the respirator mask and also improves the sealing and snug-fit of the mask against the wearer's face.

Figure 7:
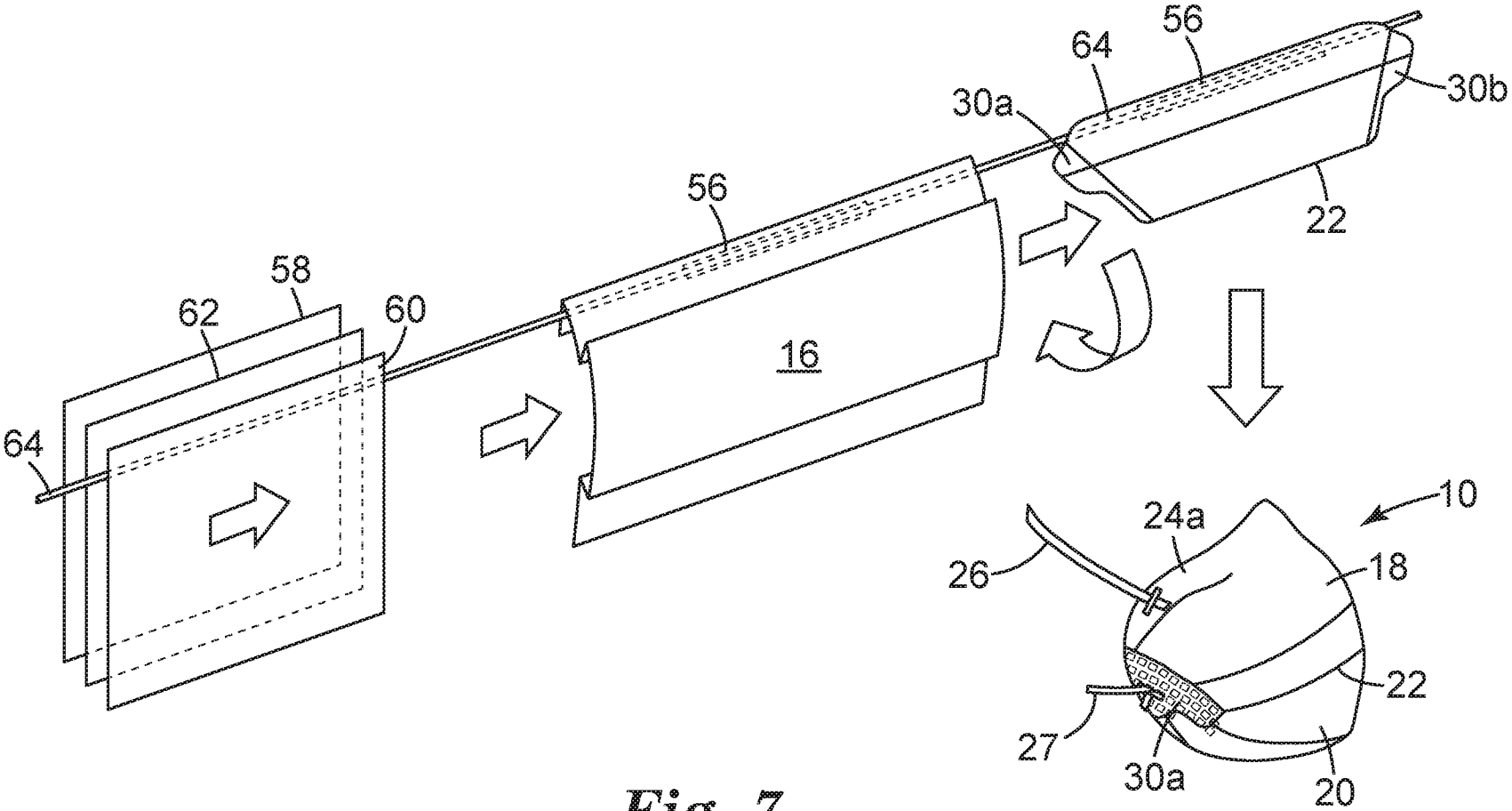
FIG. 7 is a schematic process for forming a flat-fold filtering face-piece respirator 10 having a nose clip 56 and a cushioning member 64.

FIG. 7 illustrates an exemplary method for forming a flat-fold filtering face-piece respirator 10 having a nose clip 56 and a cushioning member 64, such as that illustrated in FIGS. 1, 2 and 3*a*, 3*b*. The respirator 10 is assembled in two operations—mask body making and mask finishing. The mask body making stage includes (a) lamination and fixing of nonwoven fibrous webs, (b) insertion of an extended length of cushioning material, (c) insertion of the nose clip, (d) formation of pleat crease lines, (e) folding of pleats along embossed crease lines, (f) sealing the lateral mask edges and (g) cutting the final form, which may be done in any sequence(s) or combination(s). The mask finishing operation may include forming a cup-shaped-structure and connecting the flanges to the cup-shaped structure and attaching a harness (e.g., straps or headband). At least portions of this method can be considered a continuous process rather than a batch process; for example, the mask body can be made by a process that is continuous in the machine direction. Additionally, the cushioning member can be inserted as a continuous process, whether the cushioning member is an elongate member (as in FIG. 3*b*) or cut to desired size (as in FIG. 3*a*).

Three individual material sheets, an inner cover web 58, an outer cover web 60, and a filtration layer 62, are brought together and plied in face-to-face orientation together with an extended length of cushioning rope material that will form the cushioning member 64. The cushioning rope material is fed between the filtration layer 62 and the inner cover web 58. These materials are then laminated together, for example, by adhesive, thermal welding, or ultrasonic welding, to form the filtering structure 16 and cut to desired size, with the cushioning rope material present between two of the layers of 58, 60, 62. In alternate embodiments, the cushioning material is applied on a surface of the laminated webs (e.g., on the surface of the inner cover web 58) and the laminated filtering structure 16 is folded over to form a pocket around the cushioning material.

A nose clip 56 is attached to the sized laminated filtering structure 16, in some embodiments on the outer cover web 60, in other embodiments in a pocket formed between the outer cover web 60 and the filtration layer 62, and in yet other embodiments in a pocket formed between the outer cover web 60 and the inner cover web 58, the inner cover web 58 having been folded over. The resulting laminate with the cushioning member 64 and the nose clip 56 is then folded and/or pleated and various seals and bonds are made, including demarcation line 22. The folded laminate material is then further folded and additional seals are made to form various features, such as the flanges 30*a*, 30*b*, on the flat mask body.

Straps 26, 27 are added and the flat mask can be expanded to a cup shape, resulting in the filtering face-piece respirator 10 having the demarcation line 22 separating the top portion 18 from the bottom portion 20, and with cushioning member 64 extending along the upper perimeter segment 24*a*.

This invention may take on various modifications and alterations without departing from its spirit and scope. Accordingly, this invention is not limited to the above-described but is to be controlled by the limitations set forth in the following claims and any equivalents thereof.

As an example, the cushioning member of this invention may be incorporated into 'flat' face masks, such as those commonly used in the medical profession. As another example, a cushioning member of this invention may be positioned in a region other than proximate the nose piece. For example, in some embodiments it maybe desired to position a cushioning member proximate the chin area of the mask, e.g., at lower perimeter segment 24*b*.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

a harness; and a mask body comprising a multi-layer filtering structure forming at least one pocket;

a nose clip; and a cushioning member having a thickness of at least 1 mm present within the pocket wherein the filtering structure comprises an outer cover web, a filtration layer and an inner cover web and wherein the outer cover web, the filtration layer, and inner cover web are positioned between the nose clip and the cushioning member.

2. The filtering face-piece respirator of claim 1, wherein the mask body has an exterior surface, and the nose clip is positioned on the exterior surface.

3. The filtering face-piece respirator of claim 1, wherein the nose clip is present within the pocket.

4. The filtering face-piece respirator of claim 1 comprising a second pocket formed by the filtering structure, wherein the nose clip is present within the second pocket.

5. The filtering face piece respirator of claim 1, wherein the cushioning member comprises a foam.

6. The filtering face piece respirator of claim 1; wherein the cushioning member comprises a foam having a sheath therearound.

7. The filtering face-piece respirator of claim 1, wherein the cushioning member has a thickness of at least 2 mm.

8. The filtering face-piece respirator of claim 1, wherein the cushioning member is elastic.

9. The filtering face-piece respirator of claim 1, wherein the cushioning member has a thickness at a compressed state, the thickness at the compressed state being less than 90% of the thickness at the relaxed state.

10. The filtering face-piece respirator of claim 9, wherein the thickness at the compressed state is at least 50% or less of the thickness at the relaxed state.

11. The filtering face-piece respirator of claim 1, wherein the mask body has a first side and a second opposite side, and the cushioning member extends from the first side to the second side.

12. The filtering face-piece respirator of claim 1, wherein the outer cover web and the filtration layer are positioned between the nose clip and the cushioning member.

* * * * *